US010418011B1

(12) United States Patent
Harms

(10) Patent No.: US 10,418,011 B1
(45) Date of Patent: Sep. 17, 2019

(54) BUTTON

(71) Applicant: Ableton AG, Berlin (DE)

(72) Inventor: Oliver Harms, Bestensee (DE)

(73) Assignee: Ableton AG, Berlin (DE)

( * ) Notice: Subject to any disclaimer, the term of this patent is extended or adjusted under 35 U.S.C. 154(b) by 0 days.

(21) Appl. No.: 16/253,008

(22) Filed: Jan. 21, 2019

Related U.S. Application Data

(63) Continuation of application No. 16/035,365, filed on Jul. 13, 2018.

(30) Foreign Application Priority Data

Mar. 29, 2018 (EP) ..... 18165083

(51) Int. Cl.

| | |
|---|---|
| ***H01H 13/02*** | (2006.01) |
| ***G10H 1/34*** | (2006.01) |
| ***H01H 13/703*** | (2006.01) |
| ***G10H 1/46*** | (2006.01) |
| ***H01H 13/83*** | (2006.01) |

(52) U.S. Cl.
CPC ..... *G10H 1/34* (2013.01); *G10H 1/46* (2013.01); *H01H 13/023* (2013.01); *H01H 13/703* (2013.01); *H01H 13/83* (2013.01); *G10H 2220/026* (2013.01); *H01H 2231/018* (2013.01)

(58) Field of Classification Search
CPC ..... H01H 13/83; H01H 13/023; H01H 2221/0702; H01H 2221/07; G10H 2220/026
See application file for complete search history.

(56) References Cited

U.S. PATENT DOCUMENTS 5,187,315 A 2/1993 Muramatsu et al.
6,118,435 A 9/2000 Fujita et al.
(Continued)

FOREIGN PATENT DOCUMENTS

DE 20 2004 021 505 U1 8/2008
DE 10 2008 008 921 A1 9/2008
(Continued)

OTHER PUBLICATIONS

Search Report prepared by the European Patent Office for EP18165083, dated Sep. 24, 2018, 1 page.

*Primary Examiner* — Felix O Figueroa
(74) *Attorney, Agent, or Firm* — Chernoff Vilhauer LLP

(57) ABSTRACT

A button is disclosed, which includes a button unit suspended movably vertically in Z-direction in a fixed frame and having a button body with an upper actuating surface and at least one central shaft extending vertically downwardly from the button body and extending at an upper end below the button body horizontally into an extension. The shaft and the extension having a translucent material such that they commonly form a light guide which is fixedly connected to the button body. The button additionally includes a light source vertically below the shaft. Light from the light source leaves vertically upwardly and enters the shaft from below. The button further includes a first optical device arranged in the vertical upper area of the light guide above the shaft for deflecting light that has entered the shaft from the light source in a horizontal direction into a plane of the extension.

11 Claims, 3 Drawing Sheets

(56) References Cited

U.S. PATENT DOCUMENTS

| | | | | |
|---|---|---|---|---|
| 7,663,071 | B2 * | 2/2010 | Chang | H01H 13/83 200/314 |
| 9,748,952 | B2 | 8/2017 | Bolender et al. | |
| 10,199,184 | B2 * | 2/2019 | Wang | H01H 13/023 |
| 2007/0119698 | A1 | 5/2007 | Day | |
| 2013/0342501 | A1 | 12/2013 | Molne et al. | |
| 2017/0060062 | A1 * | 3/2017 | Araishi | G03G 15/5016 |
| 2017/0269754 | A1 | 9/2017 | Liu | |
| 2018/0174777 | A1 * | 6/2018 | Clementson | H01H 13/023 |
| 2018/0218856 | A1 * | 8/2018 | Ito | H01H 13/14 |

FOREIGN PATENT DOCUMENTS

| | | | |
|---|---|---|---|
| DE | 10 2011 119 137 | A1 | 5/2012 |
| DE | 10 2012 211 935 | A1 | 1/2014 |
| DE | 10 2015 008 572 | B4 | 2/2017 |
| DE | 10 2015 121 195 | A1 | 6/2017 |
| DE | 10 2015 008 571 | B4 | 8/2017 |
| DE | 10 2016 108 899 | A1 | 11/2017 |
| EP | 2073194 | A1 | 6/2009 |
| EP | 2492786 | A1 | 8/2012 |
| EP | 2583071 | B1 | 4/2015 |
| EP | 2945152 | A1 | 11/2015 |
| EP | 2975505 | A1 | 1/2016 |
| EP | 2329343 | B1 | 4/2017 |
| EP | 3232299 | A2 | 10/2017 |
| JP | 2007052280 | A | 3/2007 |
| WO | 2011/071387 | A1 | 6/2011 |
| WO | 2015/033035 | A1 | 3/2015 |
| WO | 2015/048583 | A1 | 4/2015 |
| WO | 2017/017268 | A1 | 2/2017 |
| WO | 2017/108896 | A1 | 6/2017 |
| WO | 2017/189216 | A1 | 11/2017 |

* cited by examiner

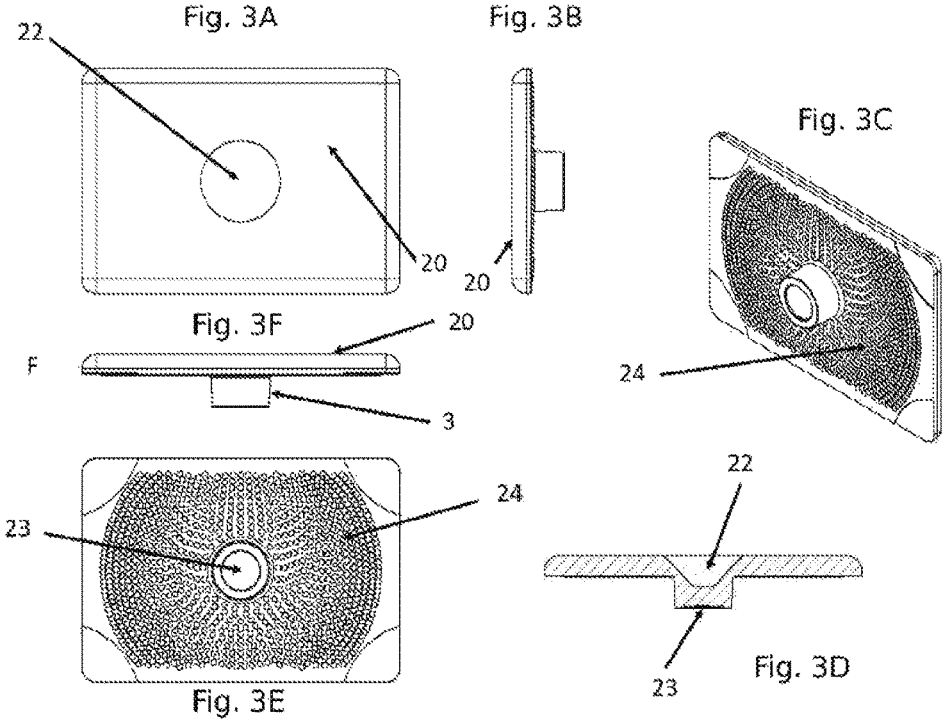
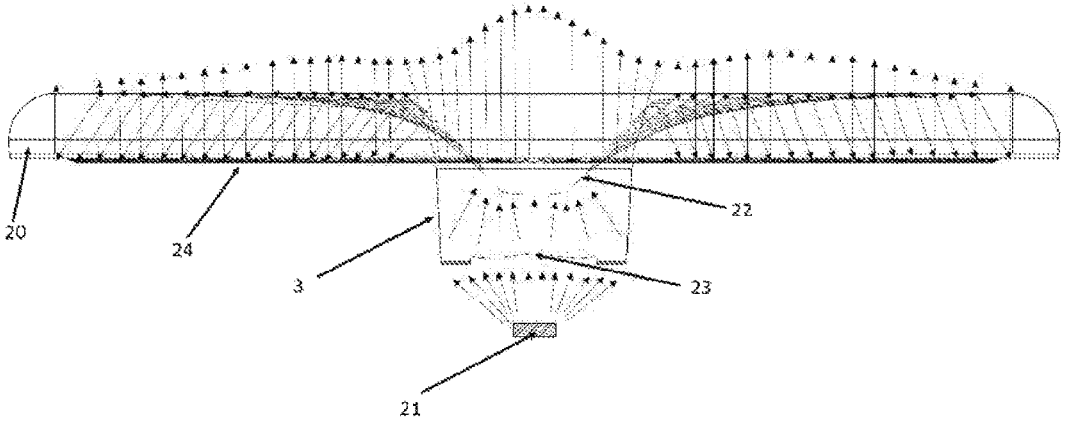
Fig. 4

BUTTON

CROSS-REFERENCE TO RELATED APPLICATION

This application is a continuation of U.S. patent application Ser. No. 16/035,365, filed Jul. 13, 2018, which claims benefit of European Application No. 18 165 083.9 filed Mar. 29, 2018. The complete disclosures of the above applications are hereby incorporated herein by reference for all purposes.

FIELD OF THE INVENTION

The present invention is related to buttons, particularly buttons which offer more extensive expression facilities to electronic musical instruments.

BACKGROUND OF THE INVENTION

Keys or buttons may be found in various areas of technology, e.g. computers, automobiles, musical instruments and many more. In particular, they are an integral component of keyboard instruments, such as the piano and the keyboard. But also modern electronic musical instruments have keys, which can, for instance, be arranged in a matrix with rows and columns (i.e., 8×8, 8×4 and so on). Analogously to the piano, the impact dynamics of the key (i.e., the velocity of the downward push) and hence the pressure applied physically to the key are detected electronically using sensor technology and analyzed electronically. The information gathered from impact velocity and pressure serves as the basis to infer the volume of the sound generated by the key pressed. However, apart from volume regulation, electronic instruments and music controllers, resp., comprising such technology, offer only limited means to formulate and manipulate, resp., the sound beyond the volume.

Ever since the conception of electronic musical instruments, it has become desirable to emulate and reproduce sound-wise, resp., other analogue instruments (e.g. string and wind instruments). Hence, there is the wish to capture, measure and ultimately to simulate the facilities of expression which are available to a musician playing analogue instruments (such as vibrato, timbre, tremolo, variations in tone and volume etc.) in electronic musical instruments. To accommodate for this wish, many electronic key-based musical instruments and controllers, resp., have additional means to manipulate and control, resp., the sound. Among these are the above-mentioned possibility to measure and analyze, resp., the keystroke upon impact, and further additional mechanisms, such as the sustain pedal, pitch bend wheel or the modulation wheel. However, not only must these additional mechanisms be used separately from the played key or button, but what is more, they only allow for the same effect to be applied to all keys—hence the particular sounds created with the keys cannot be modulated individually and thus a parallel play of several keys with different expression effects (polyphone) is not possible.

Electronic musical instruments and software-based musical instruments, resp., with their sound libraries offer a plethora of expressive sounds. To be able to control and play, resp., these sounds multi-dimensionally, i.e. corresponding to the position of, e.g., the key-striking user's finger, a sensor technology for the instrument keys and pads, resp., is needed, which can, on the one hand, analyze the finger position electronically in X-Y direction and, on the other hand, the force applied to the key an the pad, resp., by the finger in Z direction. A further important information is the detection of movements in the X-Y plane that go beyond the key/pad borders. In relation to a Cartesian coordinate system "Z direction" refers to the direction in which the—vertical—downward movement of the key or button occurs, while "X" and "Y direction" establish the orthogonal—horizontal—plain in which, e.g., the key's surface is located.

Generally, the sensors currently known to detect the force applied to the key in Z direction are FSR sensors (force sensing resistor), as disclosed, e.g., in U.S. Pat. No. 6,909,354 B2 of Interlink Electronics, Inc. An FSR is a contact sensor, which creates an electrical resistance between two electrodes in case of contact. Such sensors have certain disadvantages, e.g., a high entry threshold, a behavior that is hard to reproduce around this entry threshold and a high effort (i.e., several FSR sensor planes) to detect the X and Y dimensions simultaneously to the Z dimension.

A further disadvantage of known keys—particularly those having sensors—is the non-existent or only very limited illumination. This is due to the fact that keys or buttons with sensors must be transparent or must have breaks to guide the light if they are to be illuminated on their surface. This makes designing such keys highly problematic. An illumination, however, is in many instances desirable for the use in modern electronic musical instruments. E.g., the illumination of a just played musical note and key, resp., or the key's status can be indicated or other optical signals can be made possible.

Hence, there is still a need for a key or button and touchpad, resp., which detects not only the force (i.e., pressure) applied in Z direction, but also the position in X-Y direction of, for instance, a user's finger pressing the key. Moreover, there is still a need for a key that is sufficiently illuminated.

SUMMARY OF THE INVENTION

Thus, it is an object of the present invention to provide a button, in particular for electronic musical instruments, which makes the detection and processing of the applied force (i.e., pressure) in Z direction as well as the position in X-Y direction of, e.g., a user's finger pressing the button possible. (As stated above, "Z direction" refers to the direction in which the—vertical—downward movement of the button occurs, while "X" and "Y direction" establish the orthogonal—horizontal—plain in which, e.g., the button's surface is located.)

According to the present invention, this has been achieved with a button, comprising a button unit which is suspended movably vertically in Z direction in a fixed frame which has a button body with an upper actuating surface and at least one shaft extending vertically downwardly from the button body; a X-Y sensor unit which is arranged vertically below the button body and spaced therefrom by an air gap and which is fixed to the frame for detecting X-Y positions on the actuating surface, wherein the X-Y sensor unit has at least one opening for the at least one shaft such that the shaft can vertically move therethrough; at least one transfer element which is elastically suspended vertically below the at least one shaft and which is moved vertically downwardly upon downward movement of the at least one shaft; and a Z sensor unit which is arranged vertically below the at least one transfer element and spaced therefrom and which is fixed to the frame, wherein the Z sensor unit has at least one detection element for detecting the vertical downward movement of the at least one transfer element.

It is a further object of the invention to provide such a button with improved illumination.

According to the present invention, this has been achieved with a button, wherein furthermore the shaft extends at its upper end below the button body horizontally into an extension, wherein the shaft and the extension consist of a translucent material such that they commonly form a light guide which is fixedly connected to the button body; a light source is provided vertically below the shaft, wherein the light of the light source leaves vertically upwardly and enters the shaft from below; a first optical device for deflecting the light that has entered the shaft from the light source in a horizontal direction into the plane of the extension is arranged in the vertical upper area of the light guide above the shaft.

Further advantages of the button of the present invention are disclosed in the dependent claims.

BRIEF DESCRIPTION OF THE SEVERAL VIEWS OF THE DRAWINGS

FIG. 3A shows a top view of the light guide according to FIG. 2.

FIG. 3B shows a side view of the light guide according to FIG. 2.

FIG. 3C shows a perspective bottom view of the light guide according to FIG. 2.

FIG. 3D shows a cross-sectional side view of the light guide according to FIG. 2.

FIG. 3E shows a bottom view of the light guide according to FIG. 2.

FIG. 3F shows another side view of the light guide according to FIG. 2.

FIG. 4 shows a cross-sectional view through the light guide according to FIG. 3A-F and schematically shows the light path.

DETAILED DESCRIPTION OF THE INVENTION

As mentioned above, conventional keys or buttons for musical instruments have, among others, the one disadvantage that additional expressive facilities, possibly available through sound libraries, can neither be used polyphonically, i.e., variably for each button, nor can they be controlled multi-dimensionally, i.e., being played corresponding to the position of, e.g., a user's finger pressing the key.

The present invention overcomes these problems. The button construction of the present invention generally comprises four main units, which can be seen in FIG. 1, namely (i) a button unit 2 suspended movably vertically, (ii) a stationary X-Y sensor unit 5, (iii) a unit with a vertically moveable transfer element 7 and (iv) a stationary Z sensor unit 8.

Figure 1:
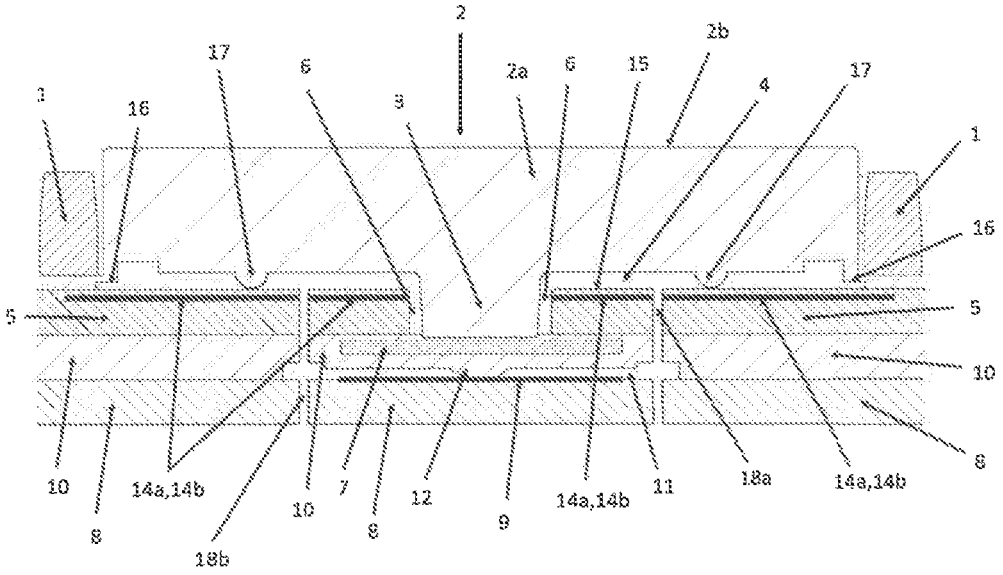
FIG. 1 shows a cross-sectional view of the button of the present invention in a preferred embodiment.

As can be seen in FIG. 1, the button comprises a button unit which is suspended movably vertically in Z direction in a fixed frame 1 and a button body 2*a* with an upper actuating surface 2*b* and at least one central shaft 3 extending vertically downwardly from the button body. The button body 2*a* can be made of a material comprising silicone. It can, e.g., be provided only one central shaft in the horizontal center of the button or there can be shafts in several places, e.g., four in each corner of the button if it is rectangular. Vertically below the button body 2*a*, fixed to the frame 1, a X-Y sensor unit 5 is provided, which has at least one opening 6 for the movement of the at least one shaft 3 of the button unit 2 in Z direction. Thus, if one central shaft 3 is provided in the button unit 2, there is also one central opening 6 in the X-Y sensor unit 5. If there are, e.g., four shafts 3 in the button unit 2, there are also four openings 6 in the X-Y sensor unit 5, namely one for each shaft 3. The X-Y sensor unit 5, which is arranged vertically below the button body 2*a* and spaced therefrom by an air gap 4, serves the purpose of detecting X-Y positions on the actuating surface 2*b* of the button unit 2, so that, for instance, the X-Y position of a user's finger on the actuating surface 2*b* can be detected. Vertically below the at least one shaft 3 of the button unit 2, there is at least one transfer element 7 which is elastically suspended and moved vertically downwardly upon downward movement of the at least one shaft 3.

If one central shaft 3 is provided in the button unit 2, there is one transfer element 7 below. If there are, e.g., four shafts 3 in the button unit 2, four transfer elements 7 can be provided—namely one for each shaft 3—but there can also only be one transfer element 7 for all four shafts 3.

Below the at least one transfer element 7 and vertically spaced therefrom and fixed to the frame 1, is a Z sensor unit 8, which has at least one detection element 9 for detecting the vertical downward movement of the at least one transfer element 7. Contrary to the opening or openings 6 in the X-Y sensor unit 5, the horizontal alignment of the at least one transfer element 7 and the at least one detection element 9 is not dependent on the location of shaft 3 or shafts 3 and its or their horizontal position. This means that, irrespective of the amount of shafts 3 and their horizontal position, (i) only one transfer element 7 and only one detection element 9 can be provided, or (ii) only one transfer element 7 but one detection element 9 per shaft 3, or (iii) the reverse, namely only one detection element 9, but one transfer element 7 per shaft 3, or (iv) one transfer element 7 as well as one detection element 9 per shaft 3. Hence, the button of the present invention comprises two sensors, one of which is located below the other—one sensor to detect a vertical movement of the button in Z direction and one sensor to detect the X-Y position on the button's actuating surface—, and can therefore be considered multi-dimensional in the sense described above.

The transfer element 7 can optionally be embedded in an elastic electrically insulating substrate 10 and can be at least partially surrounded by the substrate or applied thereto. Optionally, an air gap 11 can be provided in the substrate 10 vertically below the transfer element 7 and spaced therefrom. In this way, a nearly barrier-free downward movement of the transfer element 7 is possible, whereby a notably lessened application of force is necessary to actuate the button, reducing its response pressure. Moreover, the substrate 10 can optionally be provided with at least one semicircular or conical resilient protrusion 12 in the area of the air gap 11 and protruding vertically into the air gap 11. This at least one protrusion 12 serves as a resilient return assist. The substrate 10 can comprise silicone.

The Z sensor unit 8 can optionally comprise a substrate 13, while the detection element 9 is located vertically on top of the substrate 13 and/or is at least partly embedded into the substrate 13. The effectiveness of the detection element 9 can be increased by a partial embedding: If, e.g., the detection element 9 is a coil in connection with an LC resonator (see below for further information), it can be extended onto several layers within substrate 13 of unit 8—however, the inductivity increases with the coil's length, which, in turn, increases the sensor's sensitivity, among other things (the properties of the LC resonator also change because the coil is a part thereof).

The button body 2*a* can optionally be suspended on the frame 1 by a movement crimp 16 surrounding the button body. This movement crimp is formed in one piece with the button body 2*a* and is realized in a tapering of the material on the horizontal rim around the button body 2*a*. Thereby, a nearly barrier-free downward movement of the button body 2*a* is possible, whereby the button can be actuated with less force, which reduces the button's response pressure—as already discussed in connection with the air gap 11.

The X-Y sensor unit 5 can optionally be provided with a semicircular or conical protrusion 17 protruding into the air gap 4 on its top side or on the bottom side of the button body 2*a*, horizontally outside the at least one shaft 3. This at least one protrusion 17 serves—as already discussed in connection with the air gap 11—as a resilient return assist.

A pressure equalization line 18*a* can optionally be provided between the air gaps 4 and 11, and the air gap 11 can furthermore be vented to the environment by at least one pressure equalization line 18*b* extending through the Z sensor unit 8. Thereby a sufficient pressure equalization between the air gaps 4 and 11 is ensured.

The X-Y sensor unit 5 and the Z sensor unit 8 can optionally be fixedly spaced from each other by a spacer 19 provided vertically therebetween. Thereby not only the steadiness of the entire button arrangement is improved, but also its overall rigidity is increased.

The sensor units 5 and 8 which are used in the above described button, can be differently designed electronically. In a preferred embodiment, the sensor unit 8 comprises an inductive sensor. Commonly, an inductive sensor comprises an oscillating circuit with an LC resonator (L refers to the inductivity of the coil used therein and C refers to the capacity of the capacitor also used therein) and measures its frequency (LC resonator frequency) with the help of a reference oscillator (reference frequency). Therewith, also the impedance Z and the quality Q of the LC resonator can be determined in addition to the inductivity. The coil thereby emits a magnetic field, which causes eddy currents in an electrically conductive material moved relatively thereto. This causes the amplitude and the frequency of the oscillating circuit to change. In the present case, the detection element 9 is an induction coil and the transfer element 7 comprises a metallic material. If force and pressure, resp., are applied to the button, e.g., with a finger, the shaft 3 moves downwards, which in turn decreases the space between the thereby also downwardly moving metallic transfer element 7 and the induction coil 9, resulting in the above described effects.

The X-Y sensor unit 5 comprises a capacitive position sensor in the preferred embodiment. Commonly, a capacitive X-Y sensor comprises a grid of RX and TX electrodes, wherein the RX electrodes are electrically connected to one another in columns and the TX electrodes in rows—without an electrical connection between the RX and the TX electrodes and wherein the capacity between the electrodes is being measured very quickly and repeatedly. The capacity depends on the permittivity of the matter which is located in the close proximity of the electrodes. For instance, if a finger, which has much higher permittivity than the surrounding air due to its water content, comes close to this arrangement, the capacity between the electrodes changes. Therewith the two-dimensional X-Y position of the finger on and above, resp., the grid can be determined. Hence, if a finger is being pulled over the grid, the change in capacity between the electrodes moves likewise. In the present case, the X-Y sensor unit 5 comprises the RX and TX electrodes 14*a* and 14*b*, while the button body 2*a* is non-metallic.

The X-Y sensor unit 5 can comprise a cover layer 15 covering the electrodes 14*a* and 14*b* for the following purpose: In a capacitive sensor the field strength between the objects acting capacitively and the electrodes exhibits quadratic decrease with the distance between them. Hence, the field strength is very high if the distance is very short and, in case of objects acting capacitively and having a movement tolerance in the electric field at a short distance from the electrodes, this can lead to disproportionate sensor signals the results of which cannot be processed in a sensible manner. By way of the cover layer 15 these very short distances between the sensor electrodes and the objects acting capacitively and having movement tolerance can be increased. Thus, the dynamic range is optimized and the sensor signal usable in this way is conditioned.

With such a button, further sound expressions such as vibrato, timbre, tremolo, tonal and volume variations etc. can be provided for music instruments individually per button through the registration of the X-Y positions of, e.g., a finger on a button—instead of merely one-dimensionally in Z direction.

In another embodiment the Z sensor unit 8 can comprise a capacitive pressure sensor instead of an inductive one, wherein (i) the transfer element 7 is a capacitive electrode embedded at least partially in an elastic electrically conductive substrate 10'; (ii) the detection element 9 is an electrode embedded electrically insulated against the transfer element 7 and the substrate 10'; and (iii) an electrical connection between the transfer element 7 and the unit 8 is provided by the conductive substrate 10' such that the transfer element 7 and the detection element 9 form a plate capacitor the signals of which are available for further processing on unit 8. Thus, in such a capacitive pressure sensor, the capacity change, resulting from the change in the distance between the electrode of transfer element 7 and the electrode of detection element 9, is processed as a sensor effect. The substrate 10' can consist of silicone comprising a homogenous mixture of electrically conductive fillers.

In yet another embodiment, the sensor unit 8 can comprise a magnetic sensor, wherein (i) the transfer element 7 is a magnet embedded at least partially in an elastic electrically insulating substrate 10, wherein the north pole of the magnet points vertically upwardly or downwardly; and (ii) the detection element 9 is a HALL sensor. When a current flows through the HALL sensor, which is located in the orthogonally extending magnetic field of transfer element 7, the HALL sensor provides an electric voltage, which is proportional to the product of the magnetic flux density and the applied current—this voltage changes in accordance with the distance alteration between magnet and HALL sensor caused by pressing the button.

According to a further aspect of the present invention, the embodiments of the inventive button described above can be illuminated. For this purpose the button comprises a shaft 3 extending at its upper end below the button body 2*a* horizontally into an extension 20, which can be formed in one piece with the shaft as can be obtained from FIG. 2. The shaft 3 and the extension 20 consist of a translucent material such that they commonly form a light guide which is fixedly connected to the button body 2*a*, e.g., through layering, gluing, casting etc. A light source 21 is provided vertically below the shaft 3 of the button unit 2, e.g. an LED, wherein the light of the light source leaves vertically upwardly and enters the shaft 3 from below.

Figure 2:
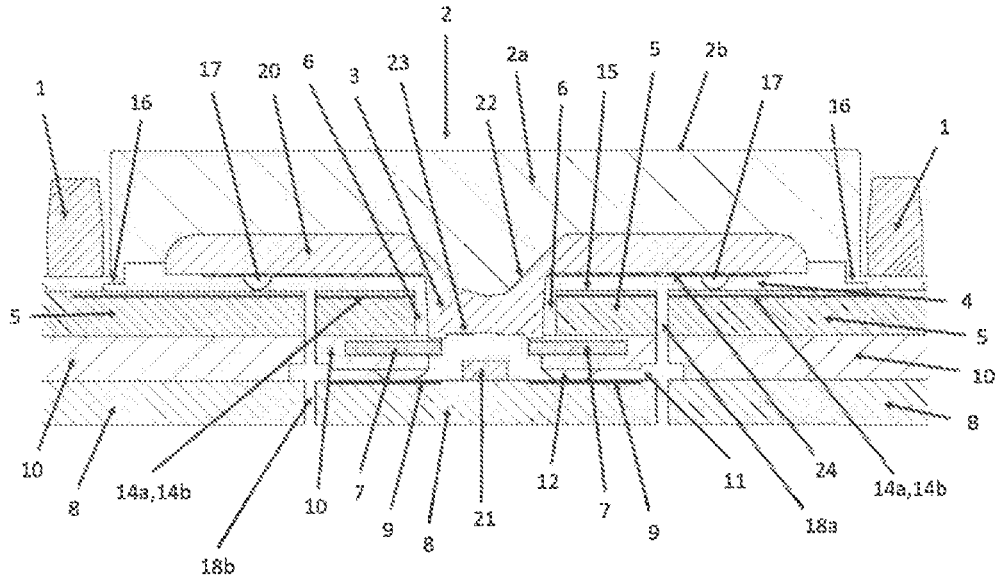
FIG. 2 shows the cross-sectional view of the button in FIG. 1 with additional illumination.

A first optical device 22 for deflecting the light that has entered the shaft 3 from the light source 21 in a horizontal direction into the plane of the extension 20 is arranged in the vertical upper area of the light guide above the shaft 3. This first optical device 22 can, e.g., be a free form conical lens consisting in a conical recess within the light guide. This is a type of conical lens that is shaped in such a way that the light entering vertically from below into the shaft 3 is, on the one hand, deflected horizontally by subjecting the majority of the light at the borderline of lens 22 to total reflection, while, on the other hand, a part of the light is radiating directly upwardly through the lens. FIGS. 2 and 3D show a cross-sectional view of such a lens 22 in the shape of a conical recess which does not have a tip in its lower area but is rounded and whose lateral surface is bent.

A button illuminated in this way can optionally comprise a second optical device 23, which is arranged in the vertical lower area of the shaft 3, for focusing the light that has entered the shaft 3 from the light source 21 in the direction of the first optical device 22 (collimation). This second optical device 23 can be, e.g., a free form collecting lens for coupling the light, which consists in an appropriate surface molding of the lower end of the shaft 3. In particular, the surface molding can be shaped with convex and concave segments, e.g. wavelike, in such a way that it deflects the majority of the light onto the lateral surface of the free form conical lens 22.

The illuminated button can optionally comprise at least one light scattering element 24 which is arranged at the bottom side of the extension 20. This light scattering element 24 serves the purpose of deflecting the light radiating downwardly in the light guide in such a way that the light is reflected upwards and can, e.g., comprise surface structures at the bottom side of the extension 20, e.g., in the shape of spherical caps.

FIG. 3 A-F show different views of the light guide consisting of the shaft 3 and the extension 20 and being equipped with the first and second optical devices 22 and 23 as well as the light scattering element 24. FIG. 4 shows a cross-sectional view through this light guide with the light path.

The first optical device 22 can optionally be filled with the material the button body 2*a* is made of to correct brightness concentrations in the center of the actuating surface 2*b*. This material can be silicone.

The button body 2*a* can optionally further consist of silicone and the first optical device 22 can be filled with silicone. Furthermore, the material the button body 2*a* is made of can be pigmented with titanium dioxide or aluminum oxide. In the same way, the shaft 3 and the extension 20 forming the light guide can be pigmented with titanium dioxide or aluminum oxide. Light scattering can be attained by such pigmentation.

With a button illuminated in such a way a musical note just played and a button, resp., or the button status or other optical signals can be indicated.

Figure 5:
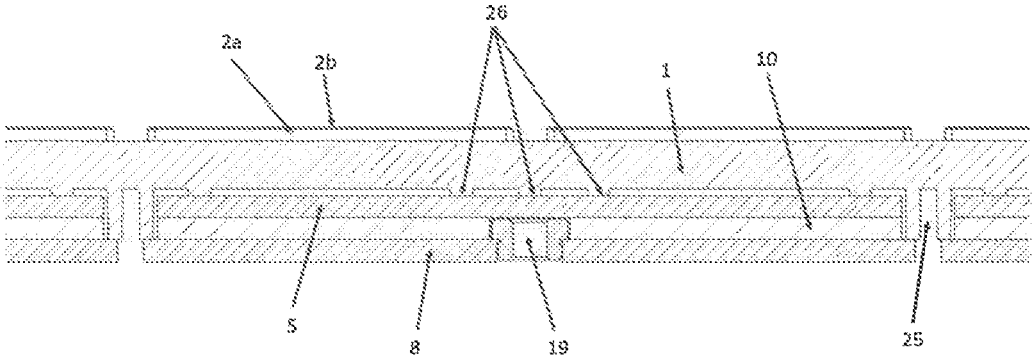
FIG. 5 shows a cross-sectional view of the frame with several buttons aligned in a row.

It must be noted that the frame 1 can be a fixed component of a device casing or a device cover panel or front panel in which the button of the present invention is fitted. FIG. 5 shows a cross-sectional view of the frame 1 with several adjoining buttons as described above. The frame 1 has screw fitting domes 15 extending from frame 1 across the X-Y sensor unit 5 and substrate 10 along with the transfer element 7 to the Z sensor unit and serve the purpose of screwing the aforementioned together tightly. Moreover, frame 1 has distance protrusions 26 by which the frame is spaced from the X-Y sensor unit 5.

Figure 6:
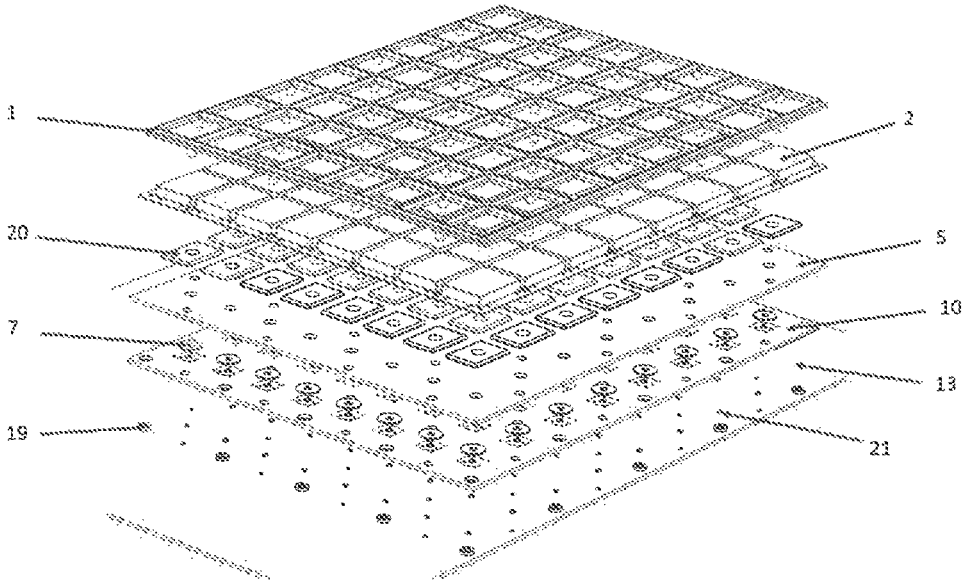
FIG. 6 shows an exploded view of several buttons aligned in a grid.

FIG. 6 shows an exploded view of several buttons of the present invention in a grid arrangement.

Furthermore, it must be noted that the button illumination disclosed above as an addition to the button described previously can also be used in other buttons, which must not necessarily comprise all features of the previously described button.

Paragraph 1. A button illuminated in this way comprises the following features:

- a button unit 2 which is suspended movably vertically in Z direction in a fixed frame 1 and which has a button body 2*a* with an upper actuating surface 2*b* and at least one central shaft 3 extending vertically downwardly from the button body and extending at its upper end below the button body 2*a* horizontally into an extension 20, wherein the shaft 3 and the extension 20 consist of a translucent material such that they commonly form a light guide which is fixedly connected to the button body 2*a;*
- a light source 21 vertically below the shaft 3, wherein the light of the light source leaves vertically upwardly and enters the shaft 3 from below;
- a first optical device 22 for deflecting the light that has entered the shaft 3 from the light source 21 in a horizontal direction into the plane of the extension 20 and being arranged in the vertical upper area of the light guide above the shaft 3.

Paragraph 2. Illuminated button according to Paragraph 1, wherein the first optical device 22 is a free form conical lens.

Paragraph 3. Illuminated button according to Paragraph 1 or 2, further comprising a second optical device 23 for collimating the light that has entered the shaft 3 from the light source 21 in the direction of the first optical device 22 is arranged in the vertical lower area of the shaft 3.

Paragraph 4. Illuminated button according to one of Paragraphs 1-3, wherein the second optical device 23 is the free form collecting lens for coupling the light.

Paragraph 5. Illuminated button according to Paragraph 2 and 4, wherein the free form collecting lens 23 is designed in such a way that the major part of the light is deflected to the surface area of the fee form conical lens 22.

Paragraph 6. Illuminated button according to one of Paragraphs 1-5, further comprising at least one light scattering element 24 deflecting light radiating downwardly from the light guide in such way that it is deflected upwardly is arranged at the bottom side of the extension 20.

Paragraph 7. Illuminated button according to Paragraph 6, wherein the light scattering element 24 comprises a surface structure on the bottom side of the extension 20.

Paragraph 8. Illuminated button according to one of Paragraphs 1-7, wherein the first optical device 22 is filled with the material that the button body 2*a* consists of to correct brightness concentrations in the middle of the actuating surface 2*b*.

Paragraph 9. Illuminated button according to Paragraph 8, wherein the button body 2*a* consists of silicone and the first optical device 22 is filed with silicone.

Paragraph 10. Illuminated button according to one of Paragraphs 1-9, wherein the material that the button body 2*a* consists of is pigmented with titanium dioxide or aluminum oxide.

Paragraph 11. Illuminated button according to one of Paragraphs 1-10, wherein the shaft 3 and the extension 20 forming the light guide are pigmented with titanium dioxide or aluminum oxide.

The invention claimed is:

1. A button, comprising:

a button unit (2) which is suspended movably vertically in Z direction in a fixed frame (1) and which has a button body (2*a*) consisting of a translucent material and having an upper actuating surface (2*b*) and at least one central shaft (3) extending vertically downwardly from the button body and extending at an upper end below the button body (2*a*) horizontally into an extension (20), wherein the shaft (3) and the extension (20) consist of a translucent material such that they commonly form a light guide which is fixedly connected to the button body (2*a*);

a light source (21) vertically below the shaft (3), wherein light from the light source leaves vertically upwardly and enters the shaft (3) from below;

a first optical device (22) for deflecting the light that has entered the shaft (3) from the light source (21) in a horizontal direction into a plane of the extension (20) and being arranged in a vertical upper area of the light guide above the shaft (3).

2. Button according to claim 1, wherein the first optical device (22) is a free form conical lens.

3. Button according to claim 1, further comprising a second optical device (23) for collimating the light that has entered the shaft (3) from the light source (21) in a direction of the first optical device (22) and being arranged in the vertical lower area of the shaft (3).

4. Button according to claim 3, wherein the second optical device (23) is the free form collecting lens for coupling the light.

5. Button according to claim 4, wherein the first optical device (22) is a free form conical lens, and wherein the free form collecting lens (23) is designed in such a way that a major part of the light is deflected to a surface area of the free form conical lens (22).

6. Button according to claim 1, further comprising at least one light scattering element (24) deflecting light radiating downwardly from the light guide in such way that the light is deflected upwardly is arranged at a bottom side of the extension (20).

7. Button according to claim 6, wherein the light scattering element (24) comprises a surface structure on a bottom side of the extension (20).

8. Button according to claim 1, wherein the first optical device (22) is filled with a material that the button body (2*a*) consists of to correct brightness concentrations in a middle of the actuating surface (2*b*).

9. Button according to claim 8, wherein the button body (2*a*) consists of silicone and the first optical device (22) is filed with silicone.

10. Button according to claim 1, wherein the button body (2*a*) consists of a material that is pigmented with titanium dioxide or aluminum oxide.

11. Button according to claim 1, wherein the shaft (3) and the extension (20) forming the light guide are pigmented with titanium dioxide or aluminum oxide.

* * * * *